United States Patent [19]

Boisrayon et al.

[11] B 3,987,742

[45] Oct. 26, 1976

[54] SWIVEL AIR LOCK FOR AIRTIGHT CONNECTION BETWEEN SUBMERGIBLES

[75] Inventors: Gerald M. Boisrayon, Le Beausset; Gilbert M. Martin, La Seyne sur Mer; Jean C. Mollard, Carry le Rouet, all of France

[73] Assignee: Etat Francais represente par le Deleque Ministeriel pour l'Armement, France

[22] Filed: Feb. 4, 1975

[21] Appl. No.: 546,922

[44] Published under the second Trial Voluntary Protest Program on March 16, 1976 as document No. B 546,922.

[30] Foreign Application Priority Data

Mar. 19, 1974 France ..... 74.09160

[52] U.S. Cl. ..... 114/16.6; 61/69 A

[51] Int. Cl.[2] ..... B63G 8/24

[58] Field of Search ..... 114/16.6, 16.7, 16.8, 114/49, 50; 61/69 A; 49/68; 244/161

[56] References Cited

UNITED STATES PATENTS

| | | | |
|---|---|---|---|
| 1,772,459 | 8/1930 | Grieshaber | 114/16.6 |
| 2,361,868 | 10/1944 | Prassel | 114/50 |
| 3,044,812 | 7/1962 | Giovinazzo | 114/16.6 |

FOREIGN PATENTS OR APPLICATIONS

| | | | |
|---|---|---|---|
| 307,654 | 3/1929 | United Kingdom | 114/16.6 |

*Primary Examiner*—Trygve M. Blix
*Assistant Examiner*—Jesus D. Sotelo
*Attorney, Agent, or Firm*—Stevens, Davis, Miller & Mosher

[57] ABSTRACT

An air lock in accordance with the invention is composed of two portions — a stationary hemispherical bell 6 fastened on a submarine rescue device 5 and a swivel skirt 7 in the form of a portion of a swivel joint, nested in the bell with a slight amount of play, bearing a peripheral sealing joint 28 which is applied against the hull 2 of a submarine around an opening 3. Two sealing joints 19 and 15 are placed between the bell and the skirt and the intermediate space 20 is filled with oil maintained at a constant pressure which is slightly different from the hydrostatic pressure.

7 Claims, 1 Drawing Figure

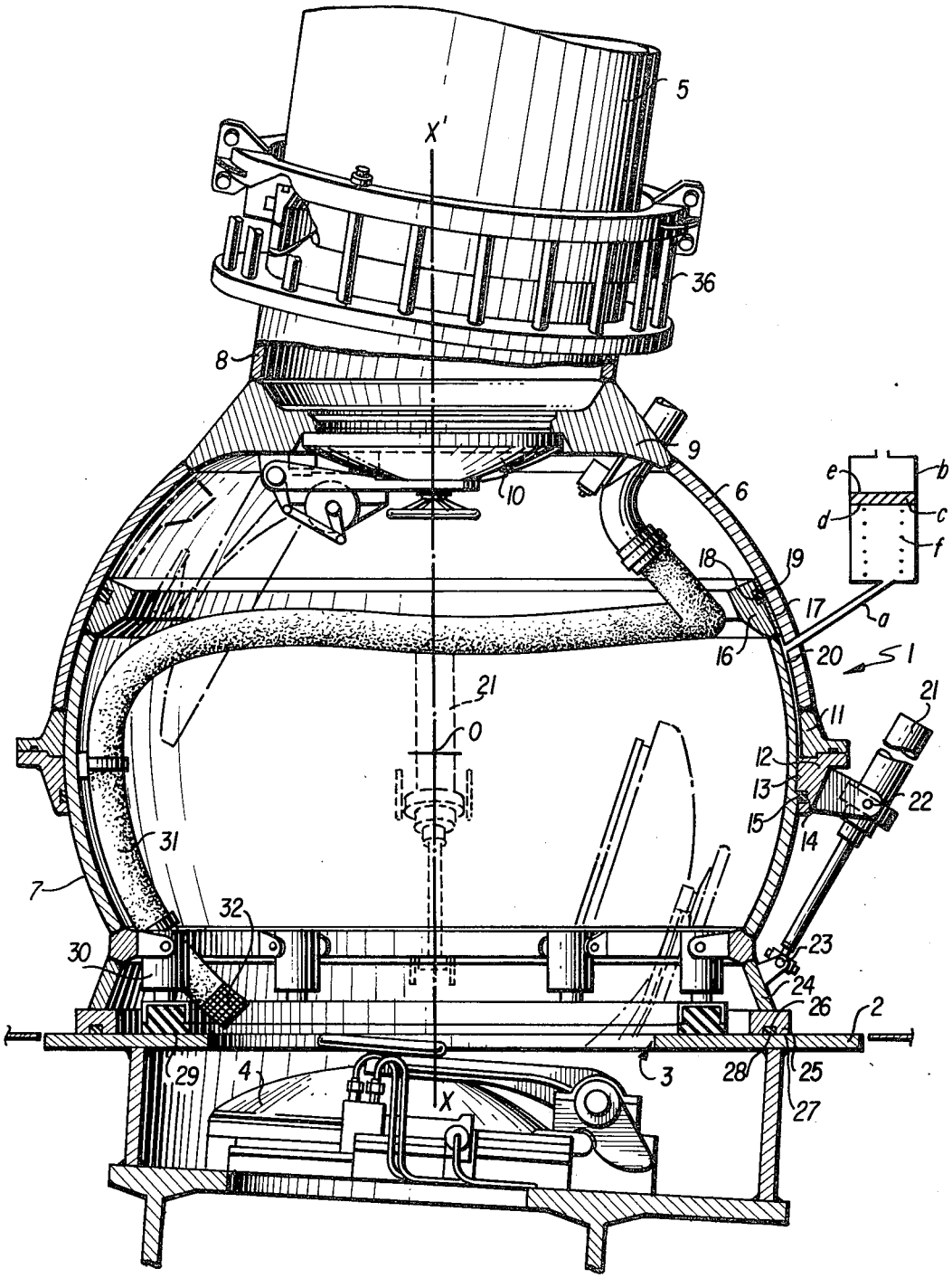
5
X'
36
8
9
10
6
e
b
d
c
f
18
19
17
a
16
20
1
21
11
21
0
12
13
22
15
14
31
7
32
23
30
24
26
2
29
4
3
28
25
27
X

SWIVEL AIR LOCK FOR AIRTIGHT CONNECTION BETWEEN SUBMERGIBLES

The object of the present invention is a swiveling air lock permitting a watertight connection between a submergible device and a submerged enclosure.

The technical art of the invention is that of naval construction and more particularly submergible devices intended to rescue the crew of a submarine in distress.

There exists today submergible devices intended to rescue the crew of a submarine in distress at a great depth. These submergible devices comprise an air lock device in the form of a large suction cup which is applied around the watertight escape hatch of the submarine. Once firmly applied to the surface of the submarine, the water contained in the air lock device is evacuated. The outer water pressure presses the air lock in a watertight manner onto the submarine and the crew can pass safely from the submarine into the rescue device.

Existing rescue devices of this type are of small size, of the order of 30 tons, so that they are relatively maneuverable which facilitates the docking on the submarine, the crew of which is to be rescued. On the other hand, the capacity of these devices is so slight that they will hold only a few persons. Thus, several trips are necessary and since each involves a docking maneuver, the operation becomes time consuming and the chance of accident is increased.

It is therefore natural and advantageous to seek to provide and use a submergible rescue device of larger tonnage, for instance of the order of 200 to 300 tons which makes it possible to rescue the entire crew of a submarine at once so that only a single coupling operation is necessary. However, as the tonnage of the rescue device increases, its maneuverability decreases and it becomes very difficult to effect the docking if the air lock forming a suction cup is a fixed one.

The object of the present invention is to facilitate and permit the coupling between a device of high tonnage and a submarine in distress or any other submerged enclosure in which atmospheric pressure or a pressure different from the hydrostatic pressure prevails, by equipping said device with a swiveling air lock which makes it possible to effect the docking even if the said device does not present itself perfectly opposite or in perfect registry with the surface on which it is to dock.

This object is achieved by equipping the said submergible device with a coupling air lock formed of two parts, one fitted in the other in airtight fashion. A first portion is fastened to said submergible device and a second portion is provided which is capable of swiveling with respect to the first portion. The second portion bears a peripheral joint which is applied against the surface of the submerged enclosure.

In a preferred embodiment, an air lock in accordance with the invention is composed on the one hand of a truncated hemispherical bell fastened around an opening of a submergible device and on the other hand a skirt having the shape of a portion of a spherical joint, embedded in the said bell in an airtight manner, with a small amount of play and articulated around the center common to said bell and said skirt, which skirt bears the said peripheral joint on the end face of its end on the outside of said bell.

The airtightness between the inside of the air lock and the outer medium is obtained preferably by a sealing joint located in a groove which is placed on the outer periphery of the end of the skirt located within the bell.

A reinforcing flange is preferably welded onto said end of the skirt and this flange bears, on its outer surface, a lining of anti-friction metal, for instance bronze, which is machined to the inside diameter of the bell.

The said bell preferably is provided at the inner periphery of its free end with a groove in which a sealing joint is housed and the space between the skirt, the bell and the two sealing joints is filled with oil maintained at a constant pressure which is slightly different for the hydrostatic pressure.

The free end of the bell preferably bears a flange located in a diametrical plane to which there is fastened a mating flange whose inner face is spherical, which holds the skirt embedded in the bell. This mating flange is provided on its inner face with a lining of anti-friction metal machined to the outside diameter of the skirt and also bears the groove containing the sealing joint. The bell and the skirt are connected by articulated jacks which make it possible to control the direction of the skirt with respect to the bell, the jacks being capable of being used solely as brakes in order to slow down the movement of the swivel with respect to the bell, allowing the latter to direct itself independently udner the action of the thrusts at the time of the docking.

In order to increase the diameter of the opening of the air lock, a crown of frustoconical shape, diverging towards the free end, is welded around the free end of the skirt and this crown comprises, around its free end, a flange in the end face of which there is provided a groove containing a toroidal sealing joint.

In order to dampen the impact at the time of docking, a ring of elastic material supported by shock absorbers is fastened to the inside of the said skirt, near its free end, in such a manner that the said ring is located slightly to the outside of the skirt before the docking.

The result of the invention is a new product, consisting of an airtight coupling lock between a submergible engine and an immersed enclosure, the said air lock being capable of swiveling.

The spherical shape of this air lock consisting of two parts articulated to each other has the advantage of both satisfying the best shape for withstanding without substantial deformation the large forces which act on the air lock when it is placed in vacuum with respect to the outside medium and also the shape which permits swiveling in all directions of the skirt with respect to the bell while retaining the airtightness between them.

Such an air lock is designed to permit rescuing crews of submarines or divers at great depths which may amount to several thousands of meters and the air lock, particularly the skirt, deforms under the effect of the very large forces which act on it. One of the problems which is very difficult to solve is to prevent these deformations from causing the jamming of the skirt in the bell.

If the joint which assures the tightness between the inside of the air lock and the outside medium is placed on the inner surface of the bell, the portion of the skirt which emerges from the bell and which is subjected to the hydrostatic pressure will then be asymmetrical. The deformations are also asymmeterical and jamming may occur.

In accordance with the very important characteristic of the invention, the sealing joint is arranged on the outer periphery of the end of the skirt which is engaged in the bell. The result is that the entire outer surface of the skirt remains subject to the hydrostatic pressure or to a pressure close thereto so that the deformations remain symmetrical and no jamming takes place.

In accordance with another feature of the invention, the space between the bell and the skirt is made airtight by a second joint located on the inner periphery of the free end of the bell. This second joint which backs up the preceding one constitutes an additional safety element. It makes it possible to fill the said intermediate space with oil and thus avoid having the sea water penetrate into the intermediate space. This oil lubricates the rubbing surfaces of the skirt and the bell and isolates the main joint from the sea water.

This oil is held under a slight vacuum or pressure with respect to the hydrostatic pressure, for instance a vacuum or pressure of a few hundred grams per square centimeter.

The following description refers to the accompanying drawing in which one embodiment of the invention is shown by way of illustration and not of limitation.

In the drawing the air lock of the present invention is designated generally by reference numeral 1. The air lock 1 is shown adjacent the hull 2 of a submarine bearing a crew exit opening at 3. An airtight pivoting closure panel 4 isolates the opening 3 from the inside of the submarine. A cylindrical conduit 5 of large diameter is fastened to a submergible rescue device. This conduit is used for transferring the crew from the submarine in distress into the rescue device. The connecting air lock 1, also referred to as transfer air lock, is fastened to the conduit 5 by an airtight flange 36, of known type.

The air lock 1 is composed of two parts: a fixed part 6 and a part 7 which can swivel in the fixed part.

The part 6 has the shape of a hemispherical bell truncated at the upper portion by which it is fastened to a cylindrical sleeve 8 which serves to fasten it to the conduit 5 via the flange 36. The bell 6 bears at its upper portion a reinforced piece 9 bearing a manhole closed by an airtight and pivoting closure panel 10. The free end of the bell 6 is located in the diametral plane perpendicular to the axis of symmetry xx'. This free end bears a welded flange 11 on which there is bolted a mating flange 12.

The inner face of this mating flange bears a lining 13 of anti-friction metal, for instance a surfacing of bronze. It also bears a groove 14 in which a toroidal sealing joint 15 is housed.

The movable part 7, referred to as the swivel skirt, has the shape of a portion of a spherical swivel joint nested in the bell 6 with a small amount of play and articulated around the center 0 common to the bell and the swivel joint. At the upper portion, this skirt bears a welded flange 16 whose outer face bears a lining 17 of anti-friction metal. This lining is machined to the inside diameter of the bell 6. In the same manner the lining 13 is machined to the outside diameter of the swivel joint 7. These two linings serve as rubbing surfaces between the bell and the swivel joint.

The flange 16 bears at its outer periphery a groove 18 into which a sealing joint 19 is placed. This joint is the main sealing joint assuring tightness between the outside medium and the inside of the air lock.

When the air lock is emptied, the joint 19 withstands the difference between the hydrostatic pressure and the atmospheric pressure within the air lock. The space 20 contained between the bell, the flange and the two joints 15 and 19 is filled with oil which is maintained at a pressure slightly different from the hydrostatic pressure. The joint 15 assures the tightness between the ambient medium and this oil and it is, therefore, not subjected to large differences in pressure.

The space 20 is connected by a conduit *a* to a constant-pressure accumulator of any known model. This accumulator consists, for instance, of a cylinder *b* in which there slides a piston *c* which is subjected on its face *d* to the pressure of oil in the space 20 and to the hydrostatic pressure on its opposite face *e*. A spring *f* urges the piston *c* in the same direction as the oil and the force of this spring is selected as a function of the constant pressure difference which it is desired to obtain. This pressure difference is calculated so that the thrust which acts on the skirt 7, as a result of the pressure difference between its two faces *d* and *e*, compensates for the apparent weight of the skirt, with due consideration of the Archimedes thrust which acts on the latter.

For example, if the surface of the skirt nested in the bell is 3000 $cm^2$ and the apparent weight of the skirt is 1 ton, a difference in pressure of 333 $gr/cm^2$ is sufficient.

It can be seen that this vacuum is relatively slight and does not produce the danger of substantial deformations of the skirt when the latter emerges from the bell asymmetrically with respect to the axis xx'.

In the case of the FIGURE, the intermediate space 20 is located to its major extent above the horizontal plane passing through the center 0 of the bell 6. In this case, this space 20 is held under a slight vacuum with respect to the ambient atmosphere so that the resultant of the pressure differences acting on the two faces of the skirt 7 compensates for the apparent weight of the skirt.

As a variant, in the event that the space 20 is located to its major part below the horizontal plane passing through the center 0, the space 20 is maintained at a pressure slightly greater than the hydrostatic pressure.

The oil which fills the space 20 serves to lubricate the contacting surfaces of the swivel joint and the bell. At the same time it prevents the sea water from penetrating into the intermediate space and from coming into contact with the sealing joint 19.

Telescopic jacks 21 are articulated both around a pin 22 which is rigidly connected with the bell 6 and around a pin 23 which is rigidly connected with the skirt. These jacks can be connected to an oil distributing device controlled from the rescue device. In this case, they make it possible to control the direction of the skirt with respect to the bell. Or else these jacks are connected to a closed circuit so that they act as brakes which retard the relative movements of the skirt with respect to the bell when the skirt comes into contact with the hull 2.

The skirt 7 has a frustoconical crown 24 welded on its free end, and diverging towards the outside of the air lock. This crown bears a flange 25 welded around its free end. A circular groove 26 is arranged in the flange 25 and opens up on the terminal face 27 of the latter which comes against the hull 2. This groove receives a toroidal sealing joint 28 which is crushed against the hull 2 by a suction-cup effect due to the vacuum in the air lock.

A ring 29 of elastic material is supported by shock absorbers 30 fastened to the inner periphery of the skirt 7 near the free opening.

Before the air lock is in contact with the hull 2, the ring 29 extends slightly to the outside of the bell so that the first contact between the hull and the air lock takes place via this ring which dampens the impact. Thereupon, under the effect of the vacuum in the air lock, the shock absorbers 30 become crushed and the ring 29 retracts into the skirt.

The drawing shows a hose 31 provided with a suction strainer 32, the hose being connected to pumps located in the rescue device which make it possible to pump out the water contained in the air lock after the docking.

Of course, various equivalent changes may be made by those skilled in the art in the air lock which has been described above solely as example, without thereby going beyond the scope of the invention.

Although there has been described in detail an application relating to the rescuing of the personnel located in a device in distress, it is clear that the air lock in accordance with the invention makes it possible more generally to effect the transfer of personnel between any vehicle bearing such air lock and a stationary or mobile immersed structure.

We claim:

1. Connecting air lock provided on a submergible device to permit the latter to connect itself in airtight fashion around an opening of an immersed enclosure, comprising a truncated hemispherical bell adapted to be positioned around an opening of a submergible device;

a skirt having the shape of a portion of a spherical swivel joint nested in the said bell in airtight fashion with a small amount of play for articulation around a center common to said bell and said skirt, said skirt having a peripheral joint on the end face of its end outside said bell, and at the outer periphery of its end nested in said bell, a groove in which a sealing joint is placed between said skirt and said bell, said bell having at the inner periphery of its free end a groove containing a sealing joint, the space contained between the skirt, the bell and the two sealing joints being filled with a lubricating liquid adapted to be maintained at a pressure which is slightly different from the hydrostatic pressure, means to adjust the constant difference between the two pressures in such a manner as to cancel out the apparent weight of the swivel skirt and thus cause its hydrostatic lift in the said hemispherical bell.

2. Connecting air lock according to claim 1, characterized by the fact that said skirt comprises a reinforcing flange welded to the outer periphery of said end nested in said bell, which flange bears on its outer face a lining of anti-friction metal machined to the inside diameter of the said bell.

3. Connecting air lock according to claim 2, characterized by the fact that the free end of said bell bears a flange located in a diametral plane and on which there is bolted a mating flange whose inner face is spherical.

4. Connecting air lock according to claim 3, characterized by the fact that the inner face of the said mating flange is lined with an anti-friction metal machined to the outside diameter of said skirt and bears the said groove which contains the sealing joint.

5. A connecting air lock according to claim 1, further comprising articulated jacks connecting said bell to said skirt.

6. A connecting air lock according to claim 1 in which a divergent frustoconical crown is welded around the free end of said skirt, said crown comprising around its free end a flange in whose terminal face a groove containing a toroidal sealing joint is recessed.

7. A connecting air lock according to claim 6, further comprising a ring of an elastic material supported by shock absorbers fastened to the inside of said joint-shaped skirt near the free end in such a manner that said ring is located slightly to the outside of the skirt before the docking.

* * * * *